US007762930B2

(12) United States Patent
Egger

(10) Patent No.: US 7,762,930 B2
(45) Date of Patent: Jul. 27, 2010

(54) ADJUSTABLE FITNESS APPARATUS HAVING A PRESSURE CHAMBER AND AN EXERCISE DEVICE WITH A SEAT

(76) Inventor: Norbert Egger, Eschenbachgasse 4a, 4020 Salzburg (AT)

( * ) Notice: Subject to any disclaimer, the term of this patent is extended or adjusted under 35 U.S.C. 154(b) by 1213 days.

(21) Appl. No.: 11/220,915

(22) Filed: Sep. 8, 2005

(65) Prior Publication Data

US 2007/0054783 A1 Mar. 8, 2007

(51) Int. Cl.
*A63B 22/06* (2006.01)

(52) U.S. Cl. ..... 482/57; 601/9

(58) Field of Classification Search ..... 482/57, 482/58, 59, 60, 63; 601/6, 9, 10, 11, 23, 601/33, 34, 35, 36, 41; 128/202.12, 205.26; 600/19, 20

See application file for complete search history.

(56) References Cited

U.S. PATENT DOCUMENTS

| | | | | | |
|---|---|---|---|---|---|
| 72,631 | A | * | 12/1867 | Hadfield | 601/11 |
| 1,336,774 | A | | 4/1920 | Cooper | |
| 2,138,527 | A | | 11/1938 | Newman | |
| 4,421,109 | A | | 12/1983 | Thornton | |
| 4,846,529 | A | * | 7/1989 | Tulley | 297/344.23 |
| 4,973,046 | A | * | 11/1990 | Maxwell | 482/60 |
| 5,133,339 | A | * | 7/1992 | Whalen et al. | 601/23 |
| 5,514,079 | A | | 5/1996 | Dillon | |
| 5,580,338 | A | * | 12/1996 | Scelta et al. | 482/62 |
| 5,823,915 | A | * | 10/1998 | Chen | 482/57 |
| 5,865,711 | A | * | 2/1999 | Chen | 482/57 |
| 6,539,946 | B2 | | 4/2003 | Weyergans | |
| 7,083,235 | B2 | * | 8/2006 | Grimm et al. | 297/423.21 |
| 7,141,007 | B2 | * | 11/2006 | Egger | 482/57 |
| 2005/0075221 | A1 | * | 4/2005 | Fond | 482/93 |

FOREIGN PATENT DOCUMENTS

| | | |
|---|---|---|
| EP | 906774 | 1/1999 |
| FR | 2102886 | 4/1972 |

OTHER PUBLICATIONS

English Abstract of EPO906774.

* cited by examiner

*Primary Examiner*—Loan Thanh
*Assistant Examiner*—Tam Nguyen
(74) *Attorney, Agent, or Firm*—Dykema Gossett PLLC

(57) ABSTRACT

The invention relates to a fitness apparatus for improving the health of the human body by a combination of physical exercise and alternating pressure applied to the body. The fitness device comprises a housing forming a pressure chamber. The housing is adapted to contain a training pressure. The training pressure is different from the ambient pressure on the outside of the housing. The housing comprises a sealable opening adapted to sealingly receive said person's waist. Within the pressure chamber, an exercise device is arranged having a seat for taking off the weight off the person's legs, a pair of movable actuation surfaces where exercise work can be introduced from the person's legs into the exercise device, and a resistance means connected to the actuation surfaces and adapted to absorb the exercise work. The actuation surfaces and the seat may be arranged to be movably adjustable relative to each other and to the opening. Further, the housing may be vertically divided into at least a first and a second part which may be slidingly separated for easier access.

30 Claims, 5 Drawing Sheets

ADJUSTABLE FITNESS APPARATUS HAVING A PRESSURE CHAMBER AND AN EXERCISE DEVICE WITH A SEAT

FIELD OF THE INVENTION

The invention relates to a fitness apparatus for improving the health of the human body by a combination of physical exercise and alternating pressure applied to the body. In particular, the invention relates to a fitness apparatus having a pressure chamber and an exercise device with a seat and operated by the legs to efficiently reduce the amount of fatty tissue in a selected body region.

BACKGROUND ART

The use of varying pressure for promoting blood circulation is known. U.S. Pat. No. 2,138,527 and U.S. Pat. No. 5,514,079 show the use of variable pressure for the treatment of injured limbs.

There exists a variety of devices for improving the physical fitness of the human body.

For example, in U.S. Pat. No. 1,336,774, an exercise bicycle is shown, which is arranges in a steam or vapour chamber. The steam chamber is sealed with a fabric cover which extends to the neck to a person such that the whole body of the person except for its head is contained within the chamber. A similar device is known from FR 2 102 886.

From the prior art, it is further known that a pressure acting on the skin of a human body and varying over time may have an effect on the blood circulation within the skin and improve the breakdown of fatty tissue within or underneath the skin.

For example U.S. Pat. No. 6,539,946 is concerned with using alternating pressure for cellulite reduction. In a high pressure phase, fluid is pressed from the lymphatic system and then sucked back in a low pressure phase, leading to an improved circulation of lymph over several alternating pressure cycles. U.S. Pat. No. 6,539,946 also contains a discussion of prior art, where a varying pressure is used for medical treatments. However, neither U.S. Pat. No. 6,539,946 nor the prior art discussed therein appears to be concerned with physical exercise. Rather, only the effect of alternating pressure on the skin of the human body is described.

The use of pressure chambers in combination with physical exercise appears to have resulted from manned spaceflight, where it became necessary to simulate the effects of gravity on the human body for prolonged durations of spaceflight.

The pants of U.S. Pat. No. 4,421,109 use low pressure acting on the abdomen and legs a person to simulate the increased blood flow to these regions. Just like in a gravitational field, the blood flow is forced to the legs and the abdomen by the low pressure. For a more accurate simulation of gravity, the pants have a plurality of pressure chambers that are supplied with low pressure that increases with increasing distance from the heart.

In U.S. Pat. No. 5,133,339, a device is used to generate a force acting on the whole body of the person, this force simulating a gravity force. If, for example, the lower part of a person is put in a pressure chamber supplied with a lower pressure than the ambient pressure, a force is generated by this pressure difference which has the same effect as an increased gravitational force. In order to correctly simulate the gravity effects, however, it is essential that the force generated by the pressure difference acts on the musculoskeletal structure of the body, i.e. the back and the legs. Thus, the device of U.S. Pat. No. 5,133,339 is to be used while standing. This, however, is of disadvantage, as for example a person with a very weak body condition, such as an adipose person, can only use the device at very weak pressures, otherwise the strain on the muscoskeletal structure and on the circulation would be too high. This means, however, that such a person cannot benefit much from an increase in blood pressure.

In applicant's co-pending Ser. No. 09/818,999, now U.S. Pat. No. 7,141,067, which is included as a whole by way of reference, and in EP-A-906,774, a fitness device with a pressure chamber and an exercise device is used for shaping the human body and increasing its fitness. In contrast to U.S. Pat. No. 5,133,339, the exercise device comprises a seat to take the weight off the person's legs so that the exercise device is used without any gravitational-like influence of pressure on the level of exercise device. This allows to adjust the level of physical exercise independently of the pressure acting on the skin. With this improvement, the effects of physical exercise and of pressure can be independently combined and tailored to the various needs and conditions of the persons using the fitness device.

Although there are several concepts for using low pressure and physical exercise to increase the fitness of a person and to reduce cellulite, there is still need to provide a fitness apparatus which is easy and safe to use, and which can be adapted to various body shapes and exercise needs.

SUMMARY OF THE INVENTION

It is therefore an object of the invention to provide a fitness apparatus which is easy and safe to use, and which can be adapted to various body shapes and exercise needs.

It is a further object of the invention to provide a fitness apparatus that allows the effect of blood circulation within the skin to be controlled independently of the level of physical exercise to accommodate the various exercise needs and conditions of persons.

These and other objects of the inventions are accomplished with the inventive fitness apparatus comprising a housing forming a pressure chamber, said housing being adapted to contain a training pressure, said training pressure being different from the ambient pressure on the outside of said housing, said housing comprising a sealable opening adapted to sealingly receive said person's waist, an exercise device arranged within said pressure chamber, said exercise device having a seat for taking off the weight off said person's legs, an actuation device having a pair of movable actuation surfaces where an exercise work can be introduced from said person's legs into said exercise device, and a resistance means connected to said actuation device and adapted to absorb said exercise work, wherein said actuation surfaces and said seat are arranged to be movably adjustable relative to each other and to said opening.

The actuation surfaces, for example pedals of a stepper, a bicycle, an ellipsoid trainer or other, are moved by the legs of the person, thus providing the physical exercise. As the weight of the person is supported by the seat, the pressure within the chamber has no effect on the physical work during exercise. Consequently, the level of cardiovascular activity and thus blood pressure and blood flow is independent of the pressure within the pressure chamber.

To accommodate different body sizes, the seat and the actuation device are arranged movable relative to each other according to the invention. More importantly, however, both the actuation surfaces and the seat are movable with respect to the opening through which the body of the person extends during exercise. This allows to adjust the extent of the pressure chamber over the person's body to the needs of the person without any adverse effects on the ergonomics of the fitness device. For example, if the abdomen is to be included within the pressure chamber, both the seat and the actuation surfaces are moved into the pressure chamber to accommodate more of the person's body within the pressure chamber. If, in contrast, the effect of the varying pressure within the pressure chamber is not to extend over the abdomen, the seat and the actuation surfaces are moved such that the abdomen is positioned outside the pressure chamber. Moreover, adjustment of the relative positions of the seat and the intersection surfaces determine, on which muscles the physical exercise is to be focused.

To further improve the ergonomics of the fitness device, the actuation device may be adjustable along a first linear path, and the seat may be adjustable along a second linear path, the first linear path being preferably inclined with respect to the second linear path. Moreover, the first linear path may be less inclined with respect to a horizontal direction than said second linear path.

The first linear path and the second linear path may be inclined with respect to each other by an angle of at least 10 degrees and at most 20, preferably 15 degrees. The first linear path may be inclined with respect to the horizontal direction at an angle between 65 and 75 degrees. The said second linear path may be inclined with respect to the horizontal direction at an angle between 80 and 90 degrees.

The fitness device may further comprise an adjustment drive system, which generates an adjustment force acting on at least one of the seat and the actuation device and is adapted to move said at least one of the seat and the actuation device along their respective adjustment paths.

The adjustment drive system may comprise a pair of first and second electric motors. The first electric motor may operatively disposed between the actuation device and the housing, the second electric motor may be operatively disposed between the seat and the housing.

To be able to handle the fitness device as an integral unit with no outer parts, the adjustment drive system may be received within said housing.

The fitness device may comprise a structure supporting the exercise device and said seat, the support structure being formed by a tubular frame which is arranged in a back part of said pressure chamber to allow enough room for the person within the pressure chamber and, at the same time, allowing a housing of small size. In particular, a height of the support structure in a vertical direction may be larger than its width in a horizontal direction. Thus, the support structure is elongated in the vertical direction, allowing for free space in the horizontal direction without any parts in the front parts. The structure may be a mounting point for the components of the fitness device, thus allowing a pre-assembly of the components on the structure as a unit prior to assembly of the housing.

Specifically, the shape of the support structure may mirror the shape of the housing of which a height in a vertical direction may be larger than a cross-sectional dimension in a horizontal direction.

At least one of the first and second linear path may be formed by a sliding surface of a part of said support structure.

The housing may comprise a first part and a second part, the first part being arranged horizontally movable with respect to the second part from a training position, in which the first part is in pressure-tight engagement with the second part, into an access position, in which the first part and the second part are spaced apart from each other to form an access opening.

In the access position, said housing may be vertically split into two halves, a first half formed by said first part, a second half formed by said second part.

The first part may be slidingly supported on a rail to ease handling and to guide the sealing surfaces onto each other during closing motion.

The rail may be directed downwards at least in an end region facing away from said second part. In particular, the first part may rest upon the floor if it is slid on the end region of the rail. Thus, the weight of the first part is taken off the rail in the end position.

Further, the downwardly sloped end of the rail secures the first part in the end position as additional force for overcoming gravity has to be used to move the first part from the end position.

For easier handling, the fitness apparatus my further comprise an access drive system, which generates a moving force acting on the first and second part and adapted to support transfer of the first and second part from the training position into the access position and/or back.

In particular, the fitness access drive system may comprise at least one spring element, preferably a pressure cylinder, that is operatively disposed between the first and said second part.

The access drive system my be adapted to generate a sealing force in the training position, the sealing force acting to form an air-tight engagement between the first part and the second part.

To secure the housing in the training position against the force generated, if the pressure chamber is supplied with a high pressure, a locking device, such as a hook device, may be provided, locking the first part to the second part in the training position.

The locking device is held in a locking position by one of a pressure and an electromagnetic force generated by said drive system thus allowing a fail-safe operation where the lock is released if power supply to the locking system fails.

To avoid an expensive sealing system and to create a unitary device without peripheral devices, at least one of the drive system and the rail, preferably both, may arranged within said housing.

A handle may be arranged on the outside of at least one of said first and said second part in a vicinity of said access opening and in a top region of said housing. The handle allows to easily close the fitness device. The indicated position in the vicinity of the opening further allows use of the handle to steady the body during exercise.

In a further improvement, the locking device may be operatively connected to said handle so that the housing may be opened using the handle.

Further, the handle may form a cover covering a seam between said first and said second half. In this configuration, the handle safeguards the person's hand against getting caught between the first and the second part of the housing.

The costs of the manufacturing of the fitness device may be lowered if the first and the second part are each formed from an integral shell made of synthetics.

The second part may form a base plate, which extends underneath said first part, preferably spaced apart from the second part to allow cooling from below.

The first and said second part may be engaged by a key and slot seal in said training position.

The fitness device may comprise a pressure pump adapted to generate a differential pressure between +60 mbar and −60 mbar with respect to an ambient pressure outside of said housing. The pressure may be alternating over time. The pump may be integrated within the housing.

The fitness device may also comprise a flexible vacuum cover, an outer perimeter of the vacuum cover being adapted to be connected in an air-tight manner to an edge of the opening and an inner perimeter of the vacuum cover being adapted to be connected in an air-tight manner with the person's body.

The above and other objects of the invention are further accomplished with a fitness apparatus for the physical training of a person, said fitness device comprising a housing forming a pressure chamber, said housing being adapted to contain a training pressure, said training pressure being different from the ambient pressure on the outside of said housing, said housing comprising a sealable opening adapted to sealingly receive said person's waist, an exercise device arranged within said pressure chamber, said exercise device having a seat for taking off the weight off said person's legs, a pair of movable actuation surfaces where exercise work from can be introduced said person's legs into said exercise device, and a resistance means connected to said actuation surfaces and adapted to absorb said exercise work, wherein said housing is vertically divided into at least a first part and a second part, said first part being connected to said second part via a sliding mechanism and being arranged horizontally movable with respect to said second part from a training position, in which said first part is in pressure-tight engagement with said second part, into an access position, in which said first part and said second part are spaced apart from each other to form an access opening.

BRIEF DESCRIPTION OF THE DRAWINGS

FIG. 2 shows a detail of the embodiment of FIG. 1 in a perspective view of;

DESCRIPTION OF THE PREFERRED EMBODIMENT

First, the structure of an embodiment of a fitness apparatus according to the invention is described with reference to FIG. 1 to 4.

Figure 1:
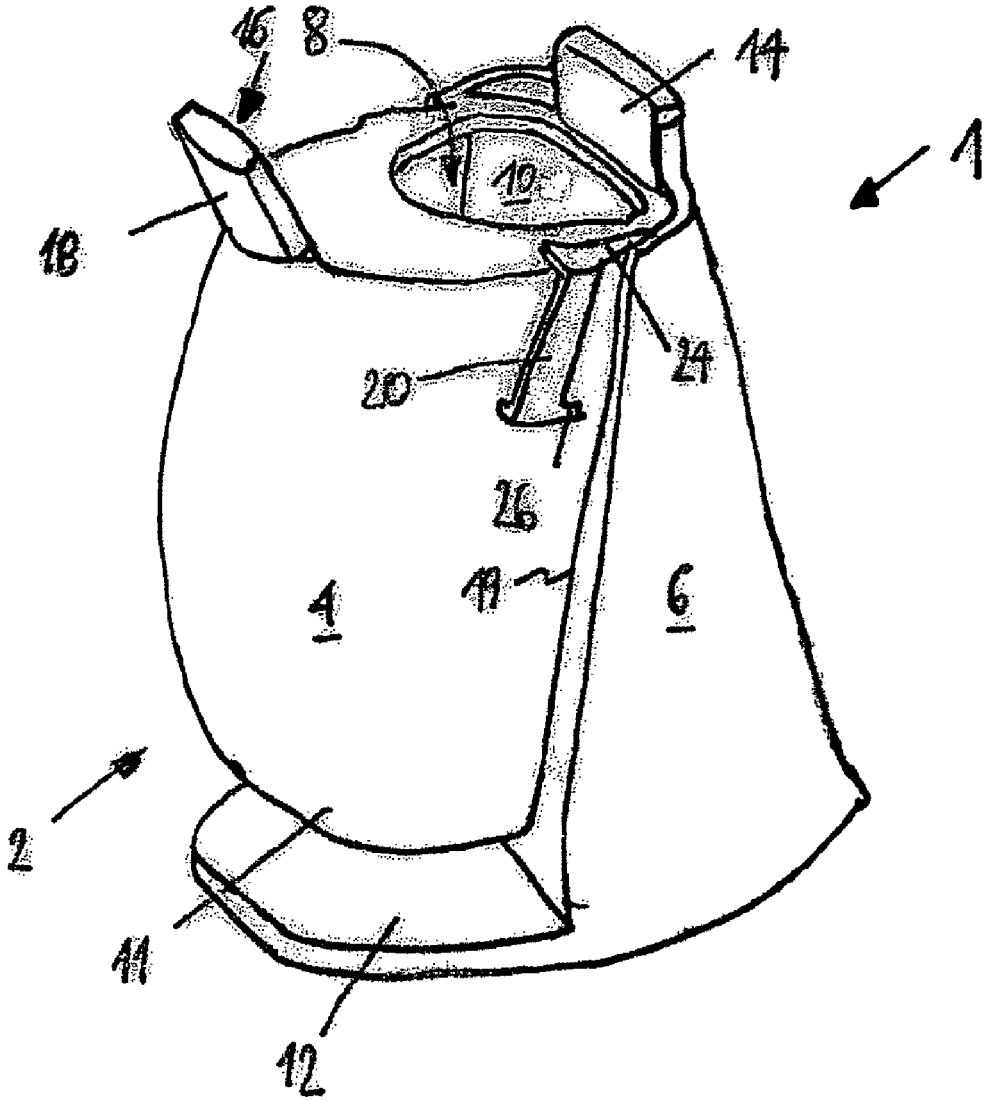
FIG. 1 shows a first schematic and perspective view of an embodiment of the invention.
Figure 2:
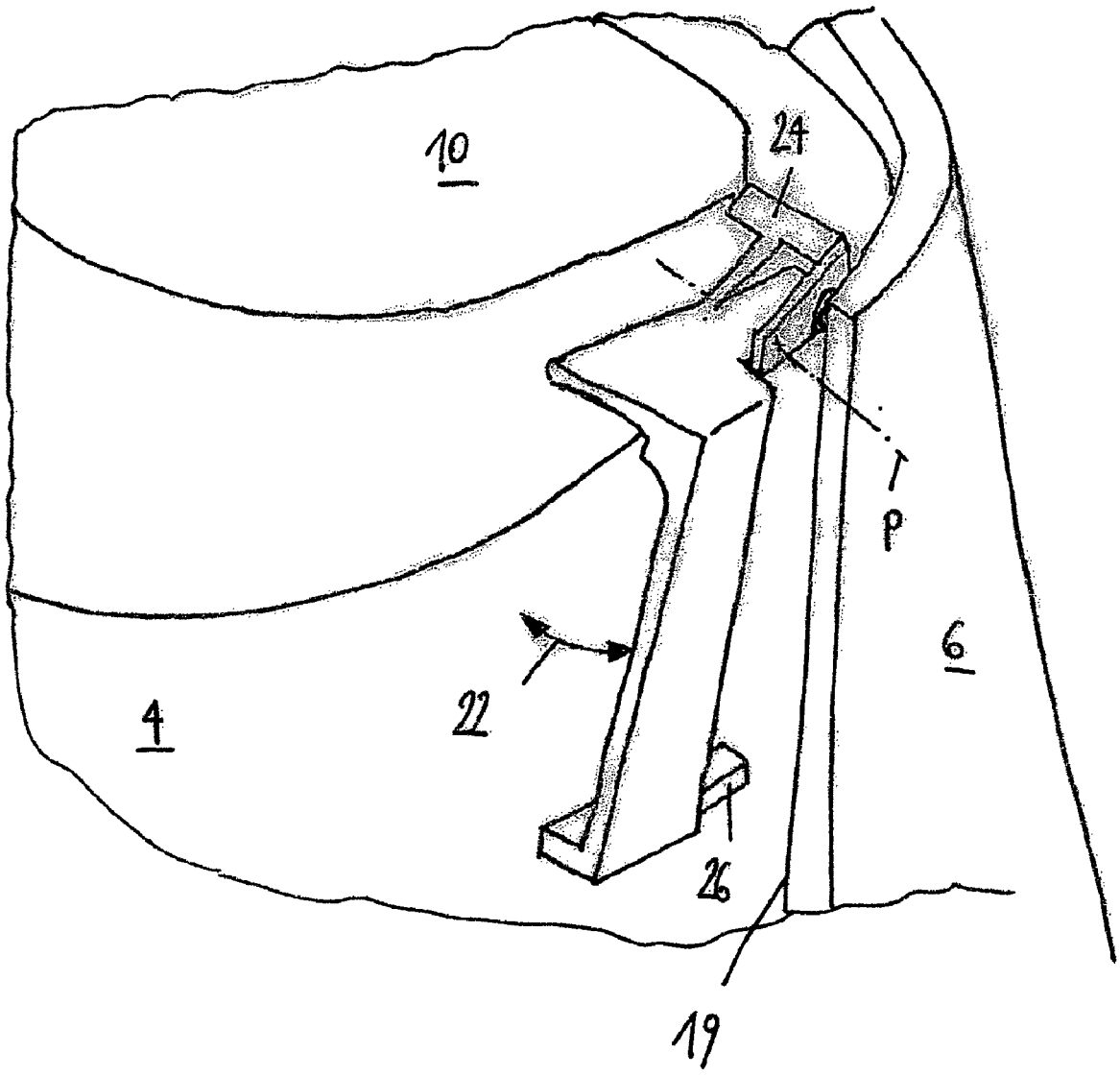

In FIG. 1, it can be seen that the fitness device 1 comprises a housing 2 of an upright ovoid shape. Housing 2 may be composed of a first, e.g. front, part 4 and second, e.g. rear, part 6. Parts 4 and 6 can be moved apart from each other into an access position shown in FIG. 3 to allow easy access into pressure chamber 8 for a person wanting to use fitness device 1. FIG. 1 shows a training position of parts 4 and 6, where parts 4 and 6 are engaged in an air-tight manner. The training position is used if a person uses fitness device 1. Both parts 4 and 6 are preferably made from a synthetic material such as a plastics material.

Housing 2 surrounds a pressure chamber 8 that opens to the top of fitness apparatus 1 via an opening 10 which extends in a substantially horizontal plane. Opening 10 is somewhat above waist-height from a bottom 11 of part 4, e.g. 1 to 1.3 meters above bottom 11. Thus, opening 10 surrounds a person using fitness device 1 at about waist- to lower-chest-level.

Except for opening 10, housing 2 encloses pressure chamber 8 in an air-tight manner so that pressure chamber 8 may be loaded with a pressure that differs from the ambient pressure outside of fitness device 1.

As can be seen from FIG. 1, second part 6 forms a base plate 12 which is used as a stand for fitness device 1. Base plate 12 extends underneath first part 4 while being spaced apart from part 4. Thus, bottom 11 of part 4 is freely accessible from below.

Further, second part 6 forms a back rest 14 which, vertically, extends beyond the plane of opening 10. To increase stability, second part 6 is preferably tapered in the upward vertical direction thus increasing the area, on which fitness apparatus 1 rests, in the front-rear direction.

Figure 4:
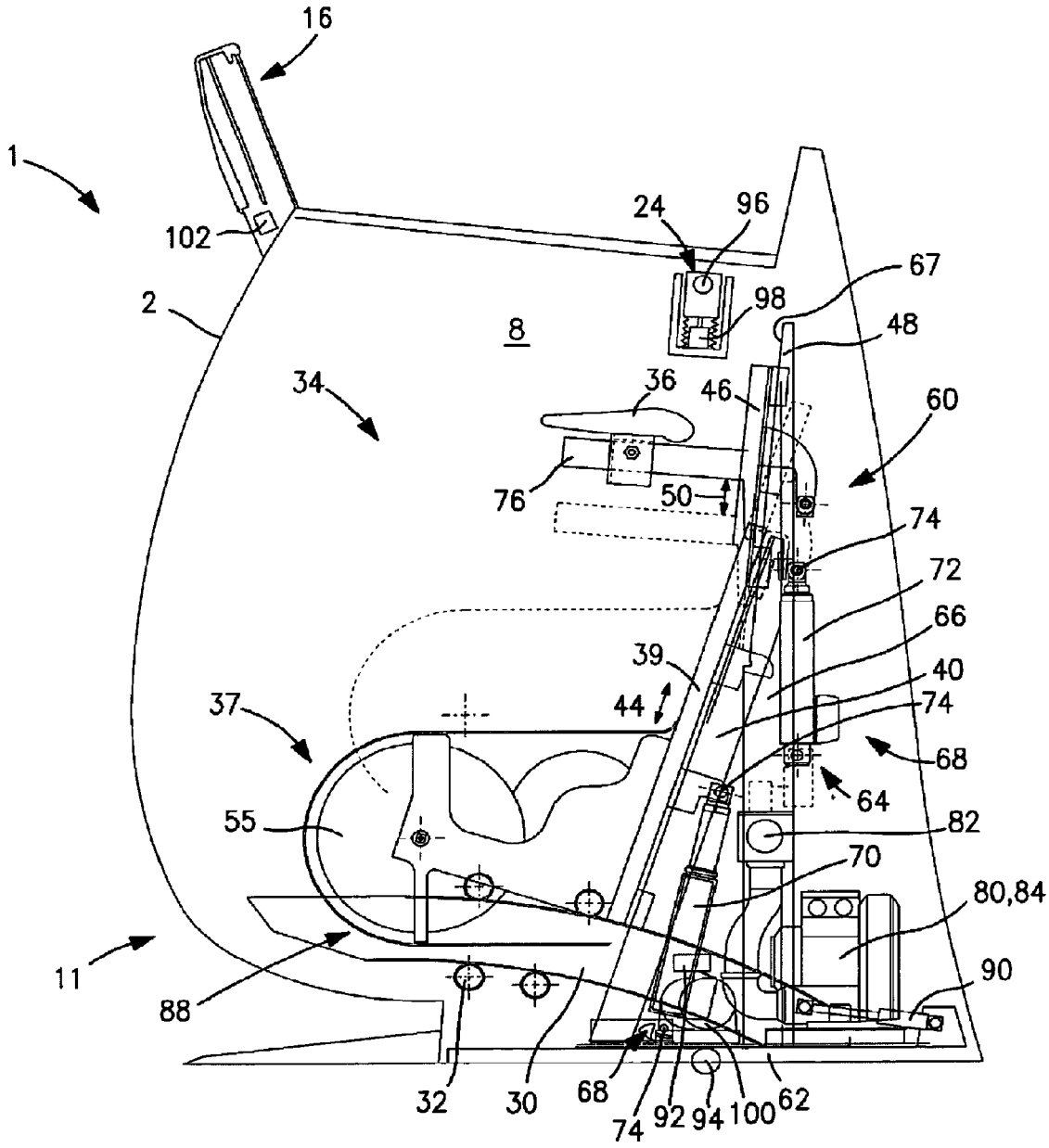
FIG. 4 shows a schematic sectional view along a substantially horizontal plane of the embodiment of FIG. 1.

First part 4 is equipped with a console device 16, such as an input device for an electronic control unit 18 shown in FIG. 4. Console device 16 may comprise for example a touch-screen and a computer display.

At both sides of fitness device, in the vicinity of a seam 19 where parts 4 and 6 are joined, preferably at the top region close to opening 10, handles 20 are provided. As can be seen from arrow 22 of FIG. 2, handles 20 are pivotably arranged on first part 4 and operatively connected to a locking device 24 locking parts 4 and 6 together in the training position. The pivot axis of handle 20 is denoted by "P" in FIG. 2. By operating handles 20, locking device 24 such as a pressure-driven hook, which is preferred, or an electromagnet may be released and engaged.

Handles 20 are spaced apart from seam 19 and, at the same time, form a protective cover so that the hands of a person operating handles 20 are not caught between parts 4 and 6. Providing a protrusion 26 extending towards seam 19 and being arranged on the end facing away from a center of pivot P of handles 20 may be an easy way to safely distance handles 20 from seam 19.

Figure 3:
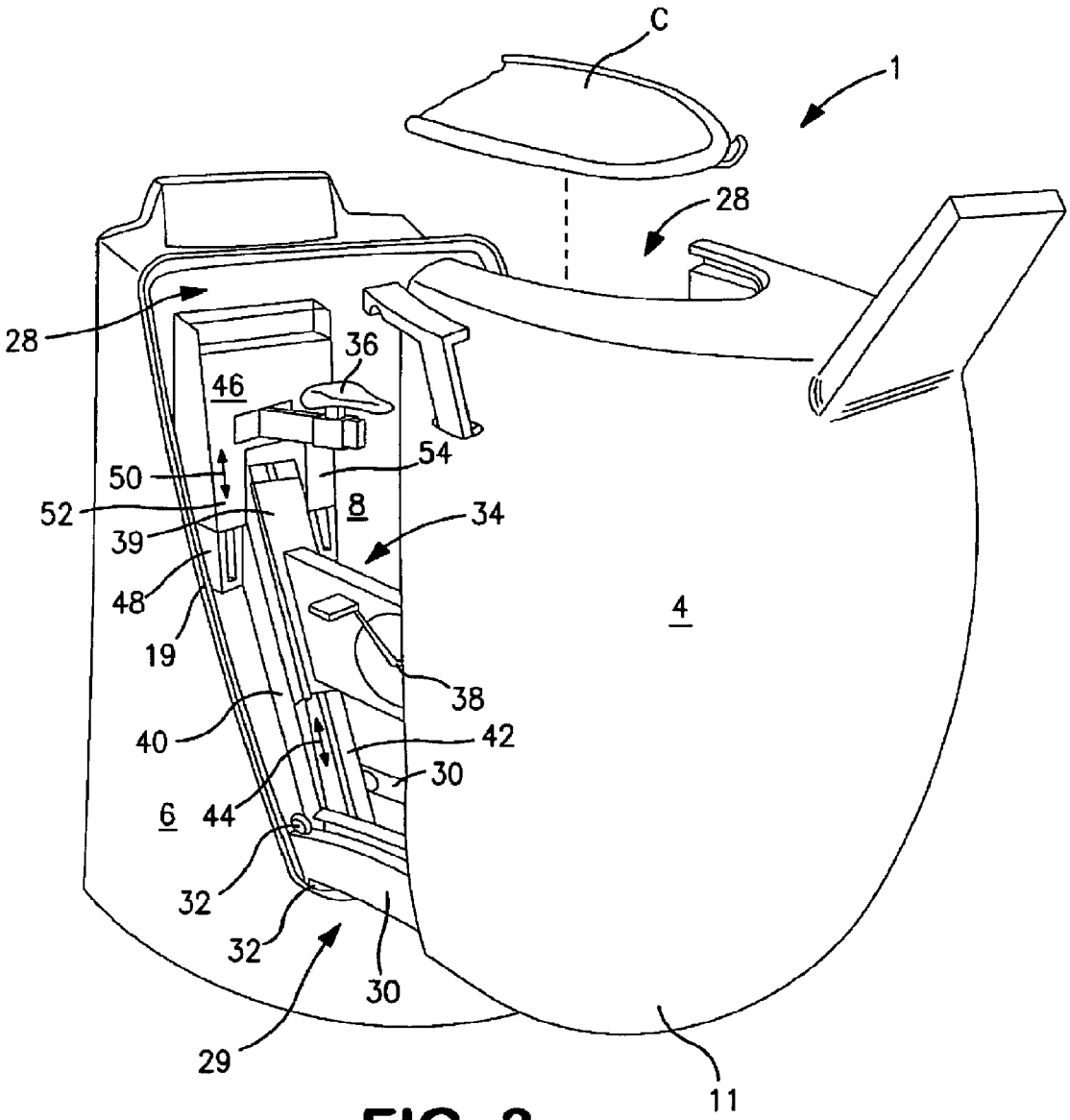
FIG. 3 shows another schematic and perspective view of the embodiment of FIG. 1.

FIG. 3 shows fitness apparatus 1 in the access position. First part 4 is slid away from second part 6 in a forward direction, thus creating a pair of access openings 28 on both sides between parts 4 and 6. For sealing parts 4 and 6, preferably a slot and key seal is used on seam 19. The same slot and key seal may be used to mount a flexible cover C in opening 10 for sealing opening 10 against the body of a person in the training position.

For opening housing 2, first part 4 is connected to second part 6 via a sliding mechanism 29. Sliding mechanism 29 may for example comprise a rail 30 or other guide and rollers 32 that are arranged within pressure chamber 8 at the height of bottom 11. For example, rail 30 may be fixed on first part 4 and rollers 32 on second part 6. Although this arrangement allows the rail to be shorter, also the reverse arrangement is possible, where rail 30 is fixed on second part 6 and rollers 32 on first part 4. Rollers 32 allow a sliding motion of rail 30 and thus a movement of first part 4 towards and away from second, stationary, part 6. To increase stability, a pair of rails 30 may be provided on each side In FIG. 3, the interior of fitness device 1 can be seen. Within pressure chamber 8, an exercise device 34 is arranged. Exercise device 34 comprises a seat 36 and an actuation device 37 having actuation surfaces 38 adapted to take up a force generated by the legs of a person using fitness device 1 and seated on seat 36. Actuation surfaces 38 may be pedals or the like.

Actuation surfaces 38 are movably mounted on a first sliding frame 39 that is slidingly supported on a first support frame 40 having a sliding surface 42. Sliding surface 42 defines a first, substantially linear path 44 for adjusting the height of exercise device 34 with respect to both opening 10 and seat 36. First linear path 44 is inclined with respect to the vertical direction. In particular, the inclination of the first path 44 may be between around 65 and 75 degrees with respect to the horizontal direction. To stabilize exercise device 34 and absorb torque acting on exercise device 34 during operation, first support frame 40 and sliding surface 42 may overlap in the lateral direction by a specified distance. This may be accomplished, as shown in FIG. 3 by e.g. arranging sliding surface 42 on both sides of support frame 40.

Seat 36 is supported on a second sliding frame 46 that may be slid on a second support frame 48 in a direction slightly inclined with respect to the vertical direction, along a second, substantially linear path 50. Second path 50 is inclined with respect to the horizontal preferably by an angle between 80 and 90 degrees. This allows for adjusting the height of seat 36 with respect to both opening 10 and actuation surfaces 38. It has been shown in experiments conducted by the inventor that very good ergonomics of exercise device 34 can be maintained irrespective of the relative position of seat 36 and actuation surfaces 38 if first linear adjustment path 44 is less inclined with respect to the horizontal direction than second linear adjustment path 50. For best results, the difference between paths 44 and 50 is between 10 and 15 degrees, in particular around 13 degrees.

As can be seen from FIG. 3, second sliding frame 46 forms two legs 52 and 54 that extend on both sides of first support frame 40. This increases the lengths of paths 44 and 50, by allowing to shift sliding frame 46 in a very low position. At the same time legs 52 and 54 form elongated support surfaces that absorb the weight of a person sitting on seat 36. Thus, stability of seat 36 is increased.

As shown in FIG. 3, exercise device 34 may be a bicycle. However, also an ellipsoid trainer or a stepper or other device may be used that may be operated by the legs of a seated person.

The structure and function of the elements of fitness device 1 within pressure chamber 8 becomes more clearly when looking at FIG. 4. It is to be noted that for clarity's sake, actuation surfaces 38 have been omitted in FIG. 4. However, it is evident from FIG. 3 that actuation surfaces 38 are, in the case of a bicycle trainer, rotatably connected to a resistance means 55, such as an eddy current brake or a fluid brake.

As can be seen from FIG. 4, housing 2 encloses a structure 60 having a support plate 62 and a support 64. On support plate 62, essentially all components of fitness device 1 are mounted, either directly, or via support 64. This arrangement allows to pre-assemble all components on structure 60 as a unit and then to mount parts 4 and 6 on the pre-assembled unit.

Structure 60 opens to the front, i.e. exercise device 34 is freely accessible from the front without any further parts impeding access. Further, to reduce space taken up by the fitness device, structure 60 is vertically elongated, i.e. its height is larger than its width in a horizontal direction. In combination with the upright ovoid shape of housing 2, which has its largest cross-section approximately at knee-level of the training person, this ensures sufficient room for the knees of the training person to move freely.

Support 64 is of substantially triangular shape and comprises inclined first support frame 40 and a substantially vertical back frame 66, which are connected to each other at the upper part, at approximately ½ to ⅘ of the total height of back frame 66. On support plate 62, first support frame 40 and back frame 66 are spaced apart from each other in the horizontal direction. In fact, first support frame 40 may consist of two bars lying parallel to each other and being arranged on both sides of back frame 66. Thus, the connecting points on support plate 62 of the two bars of first support frame 60 and back frame 66 form a triangle effecting an increase of steadiness of structure 60.

Above the region where first support frame 40 is connected to back frame 66, back frame 66 forms second support frame 48, on which seat 36 is slidingly arranged. Second linear adjustment path 50 is formed by an inclined section 67 of the front part of back frame 66.

Fitness device 1 is further provided with a drive system 68 for generating a driving force adapted to move at least one of, preferably all of, actuation surfaces 38, preferably together with resistance means 55, and seat 36, independently along their respective first and second linear adjustment paths 44 and 50. Drive system 68 is controlled via console device 16 and comprises at least two linear motors 70 and 72, which may be pressure cylinders, as shown in FIG. 4, or electric motors, such as a rotating electric motor with a gear for translating the rotatory motor movement into a translatory movement or a motor with a lifting spindle, or a linear motor.

Motor 70 is operatively disposed between first sliding frame 39 and structure 60, e.g. in the case of a pressure cylinder via joints 74 that allow a rotation of motor 70. As can be seen from FIG. 3, motor 70 may be mounted directly on support plate 62. A dotted line shows the upper end position of resistance means 55. Upon operation, motor 70 moves first sliding frame 39 along first linear adjustment path 44. A dotted line shows the upper end position of resistance means 55.

Motor 72 is operatively disposed between second sliding frame 46 and structure 60, in particular back frame 66. Upon operation, motor 72 moves second sliding frame 46 along second linear adjustment path 50. A dotted line shows a second position of a seat bar 76, on which seat 36 is arranged. To allow adjustment of seat 38 in the front-rear direction, seat 36 is slidingly held on seat bar 76 and can be fixed in any position along seat bar 76.

Motors 70 and 72 may be supplied in the case of pressure cylinders with pressure from a compressor 78. Motors 70 and 72 are received in the pressure chamber. A housing (not shown) may be provided as a protection against sweat, dirt and accidental touching by a person using fitness trainer 1.

Within pressure chamber 8, a pressure pump 80 adapted to generated a pressure both of up to +60 mbar above and −60 mbar below ambient pressure is also located. Via opening 82, pressure pump 80 may communicate with the environment to discharge or suck in air. Pressure pump 80 is also equipped with an air condition device 84, which is adapted to keep the temperature, and preferably also the humidity, of the air within pressure chamber 8 in a region that may be pre-specified via console device 16.

Console device 16 may be adjustable, as shown by dotted lines, to allow good visibility irrespective of the height and seating position of the person using the trainer.

Rail 30 is fixed to bottom 11 of part 4 and is of a bent shape extending in substantially an arc 88 from support plate 62 to bottom 11 of first part 4. The center of curvature of arc 88 is below rail 30. Thus, the path of first part 4, while moving away from part 6, is directed downwards at least close to the end position if rail 30 moves past stationary rolls 32. In the end position, part 4 may rest on the ground or on base plate 12 to relieve rail 30.

There are at least three, preferably as shown four, rollers 32 to take up any momentum generated by the weight of first part 4. Two rollers are arranged on each side of rail 30. The structure, which rotatably holds rollers 32 is not shown in FIG. 3 for clarity's sake. An upright piece of sheet metal mounted on support plate 62 may be used for this purpose.

To assist in moving first part 4, a support device 90 such as a spring element, for example a pneumatic spring may be used that is interposed between rail 30 and structure 60. However, to secure first part 4 against second part 6 in the training position, if pressure chamber 8 is loaded with a high pressure, a locking means 24 as described above is necessary.

Finally, a differential pressure sensor 92 with a pilot connection to the outside of fitness trainer 1 is arranged within pressure chamber 8 to monitor the pressure difference between pressure chamber 8 and the environment.

A wheel 94 on support plate 62 may help moving fitness apparatus 1 once assembled.

Figure 5:
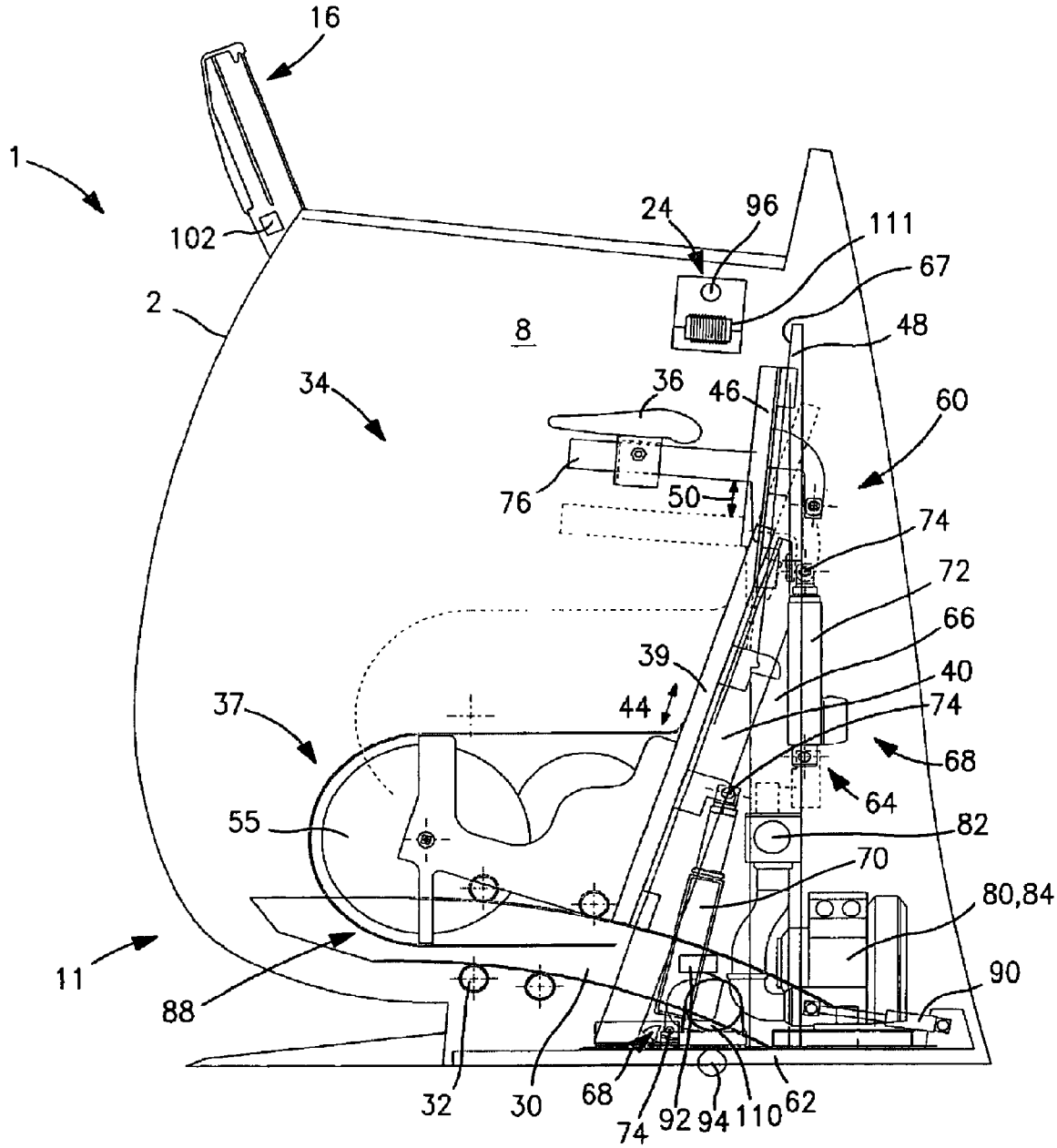
FIG. 5 shows an alternative embodiment.

Locking means 24 may comprise a hooking means, such as a bolt 96 that can be locked against a biasing force by a pressure cylinder 98 to avoid accidental opening of housing 2. If not in use, or during power failure, bolt 94 is released due to the biasing force. Pressure cylinder 98 may be activated by a compressor 100. As indicated in FIG. 5, the pressure cylinder 98 can be replaced by an electromagnet 111 and the compressor 100 can be replaced by a generator 110 which supplies electrical power to the electromagnet 111.

It is to be noted that, in an alternative arrangement, first part 4 may be stationary and second part 6 be slid away from first part 4. This, however, is not preferred, as it requires a higher design effort to move exercise device 30 together with part 6.

Next, the operation of fitness trainer 1 is described.

A person first grasps one of handles 20 to release locking mechanism 24 and to pull first part 4 away from second part 6 into the access position. In this, the person is aided by support device 90. The person enters pressure chamber 8 through the access opening and takes place on seat 38 and places his or her feet on actuation surfaces 38. Automatically, the upper body of the person will extend through opening 10. Grasping again one of handles 20, first part 4 is moved, with the help of support mechanism 90, to second part 6 and locking mechanism 24 is engaged to lock first part 4 in an air-tight manner to second part 6. A flexible cover is put around the waist of the person to seal opening 10.

Next, the person adjusts, via console device 16 and motor 72, seat 36 and actuation device 37. If the person chooses a very high position of seat 36, the pressure in pressure chamber 8 will only extend over a small portion of the abdomen. This portion is increased if the seat is lowered, as more of the person's upper body is immersed into pressure chamber 8. Again via console device 16, the position of actuation surfaces 38 is adjusted. The distance between seat 36 and actuation surfaces 38 determines which muscles will be exercised. The closer seat 36 is to actuation surfaces 38, the more the muscles in the buttocks have to work, the farther away seat 36 is, the more power will have to come from the thighs. By allowing a motorized independent adjustment of seat 36 and actuation surfaces 38, the physical exercise can be directed to specific parts of the body while, at the same time, allowing to independently adjust the surface on which the pressure acts.

Finally, the person chooses a treading resistance and an alternating pressure profile which defines a time-varying training pressure. Training pressure may vary between +60 mbar and −60 mbar.

To allow for training programs, console device 16 may comprise a memory 102, in which individual exercise programs and body measures are stored. Thus, fitness device 1 may, upon entry of a code on console device 16, automatically adapt the position of seat 36 and actuation surfaces 38 as well as the treading resistance and pressure alternations to the user's requirements.

In the specification above, one way to carry out the invention has been described with reference to the embodiment shown in the drawings. It is understood that various modifications and variations as well as different combination of features from the embodiment shown and described may exist. All these are supposed to fall within the scope of the claims as given below.

What is claimed is:

1. A fitness device for physical training of a person, said fitness device comprising:

a housing forming a pressure chamber, said housing being adapted to contain a training pressure which differs from ambient pressure on an outside of said housing, said housing comprising a sealable opening adapted to sealingly receive said person's waist, an exercise device arranged within said pressure chamber, said exercise device having a seat for taking off the weight of said person's legs, an actuation device having a pair of movable actuation surfaces where exercise work can be introduced from said person's legs into said exercise device, and a resistance means connected to said actuation surfaces and adapted to absorb said exercise work, wherein said actuation device and said seat are arranged to be movably adjustable relative to each other and to said opening and said actuation device is adjustable along a first linear path, said seat is adjustable along a second linear path, and said first linear path is inclined with respect to said second linear path by an angle of at least 10 degrees and at most 15 degrees, and an adjustment drive system which generates an adjustment force acting on at least one of said seat and said pair of actuation surfaces and is adapted to move said at least one of said seat and said pair of actuation surfaces wherein the adjustment drive system comprises at least a first electric motor for moving said pair of actuation surfaces.

2. The fitness device of claim 1, wherein said first linear path is less inclined with respect to a horizontal direction than said second linear path.

3. The fitness device of claim 2, wherein said first linear path is inclined with respect to the horizontal direction at an angle between 65 and 75 degrees.

4. The fitness device of claim 2, wherein said second linear path is inclined with respect to the horizontal direction at an angle between 80 and 90 degrees.

5. The fitness device of claim 1, wherein said adjustment drive system further comprises a second electric motor, said first electric motor being operatively disposed between said actuation device and said housing, and said second electric motor being operatively disposed between said seat and said housing.

6. The fitness device of claim 1, wherein said adjustment drive system is received within said housing.

7. A fitness device for physical training of a person, said fitness device comprising:

a housing forming a pressure chamber, said housing being adapted to contain a training pressure which differs from ambient pressure on an outside of said housing, said housing comprising a sealable opening adapted to sealingly receive said person's waist, an exercise device arranged within said pressure chamber, said exercise device having a seat for taking off the weight of said person's legs, an actuation device having a pair of movable actuation surfaces where exercise work can be introduced from said person's legs into said exercise device, and a resistance means connected to said actuation surfaces and adapted to absorb said exercise work, wherein said actuation device and said seat are arranged to be movably adjustable relative to each other and to said opening and said actuation device is adjustable along a first linear path, said seat is adjustable along a second linear path, and said first linear path is inclined with respect to said second linear path by an angle of at least 10 degrees and at most 15 degrees, and wherein said fitness device comprises a support structure supporting said exercise device and said seat, said support structure being formed by a tubular frame which is arranged in a back part of said pressure chamber.

8. The fitness device of claim 7, wherein a height of said support structure in a vertical direction is larger than its width in a horizontal direction.

9. The fitness device of claim 7, wherein at least one of said first and second linear path is formed by a sliding surface of a part of said support structure.

10. The fitness device of claim 7, wherein the greatest vertical height of said pressure chamber is larger than the greatest horizontal length of the pressure chamber.

11. The fitness device of claim 7, wherein said housing comprises a first part and a second part, said first part being arranged horizontally movable with respect to said second part from a training position, in which said first part is in air pressure-tight engagement with said second part, into an access position, in which said first part and said second part are spaced apart from each other to form an access opening.

12. The fitness device of claim 11, wherein, in said access position, said housing is split into two halves, a first half formed by said first part, a second half formed by said second part.

13. A fitness device for the physical training of a person, said fitness device comprising:

a housing forming a pressure chamber, said housing being adapted to contain a training pressure, said training pressure being different from the ambient pressure on the outside of said housing, said housing comprising a sealable opening adapted to sealingly receive said person's waist, an exercise device arranged within said pressure chamber, said exercise device having a seat for taking off the weight of said person's legs, an actuation device having a pair of movable actuation surfaces where exercise work can be introduced from said person's legs into said exercise device, and a resistance means connected to said actuation surfaces and adapted to absorb said exercise work, wherein said actuation device and said seat are arranged to be movably adjustable relative to each other and to said opening, wherein said housing comprises a first part and a second part, said first part being arranged horizontally movable with respect to said second part from a training position in which said first part is in air pressure-tight engagement with said second part, into an access position in which said first part and said second part are spaced apart from each other to form an access opening, and wherein said first part is slidingly supported on a rail.

14. The fitness device of claim 11, wherein said first part is slidingly supported on a rail and said rail is directed downwards at least in an end region facing away from said second part.

15. The fitness device of claim 11, wherein said fitness device comprises an access drive system, generating a moving force acting on said first and second part and adapted to support transfer of said first and second part from said training position into said access position.

16. The fitness device of claim 15, wherein, in said training position, said access drive system is adapted to generate a sealing force, said sealing force acting to form an air-tight engagement between said first part and said second part.

17. The fitness device of claim 15, wherein said access drive system comprises at least one pressure cylinder operatively disposed between said first and said second part.

18. The fitness device of claim 11, wherein a locking device is provided, locking said first part to said second part in said training position.

19. The fitness device of claim 15, wherein said drive system is arranged within said housing.

20. The fitness device of claim 13, wherein said rail is arranged within said housing.

21. The fitness device of claim 11, wherein at least one of said first and said second part is provided with a handle arranged in a vicinity of said access opening and in a top region of said housing.

22. The fitness device of claim 18, wherein at least one of said first and said second part is provided with a handle arranged in a vicinity of said access opening and in a top region of said housing and said locking device is operatively connected to said handle.

23. The fitness device of claim 21, wherein said handle forms a cover covering a seam between said first and said second part.

24. The fitness device of claim 11, wherein said first and said second part are each formed from an integral shell made of synthetics.

25. The fitness device of claim 11, wherein said second part comprises a base plate, said base plate extending underneath said first part.

26. The fitness device of claim 11, wherein, in said training position, said first and said second part are engaged by a key and slot seal.

27. The fitness device of claim 7, wherein said fitness device comprises a pressure pump adapted to generate a differential pressure between +60 mbar and −60 mbar with respect to an ambient pressure outside of said housing.

28. A fitness apparatus for the physical training of a person, said fitness device comprising:

a housing forming a pressure chamber, said housing being adapted to contain a training pressure, said training pressure being different from the ambient pressure on the outside of said housing, said housing comprising a sealable opening adapted to sealingly receive said person's waist, an exercise device arranged within said pressure chamber, said exercise device having a seat for taking off the weight off said person's legs, a pair of movable actuation surfaces where exercise work can be introduced from said person's legs into said exercise device, and a resistance means connected to said actuation surfaces and adapted to absorb said exercise work, wherein said housing is vertically divided into at least a first part and a second part, said first part being connected to said second part via a sliding mechanism and being arranged horizontally movable with respect to said second part from a training position, in which said first part is in pressure-tight engagement with said second part, into an access position, in which said first part and said second part are spaced apart from each other to form an access opening.

29. A fitness apparatus for the physical training of a person, said fitness device comprising:

a housing forming a pressure chamber, said housing being adapted to contain a training pressure, said training pressure being different from the ambient pressure on the outside of said housing, said housing comprising a sealable opening adapted to sealingly receive said person's waist, and a first part and a second part, said first part being arranged horizontally movable with respect to said second part from a training position, in which said first part is in air pressure-tight engagement with said second part, into an access position, in which said first part and second part are spaced apart from each other to form an access opening, wherein said first part is slidingly supported on a rail, an exercise device arranged within said pressure chamber, said exercise device having a seat for taking off the weight of said person's' legs, an actuation device having a pair of movable actuation surfaces where exercise work can be introduced from said person's legs into said exercise device, and a resistance means connected to said actuation surfaces and adapted to absorb said exercise work, wherein said actuation device and said seat are arranged to be movably adjustable relative to each other and to said opening.

30. A fitness apparatus for the physical training of a person, said fitness device comprising:

a housing forming a pressure chamber, said housing being adapted to contain a training pressure, said training pressure being different from the ambient pressure on the outside of said housing, said housing comprising a sealable opening adapted to sealingly receive said person's waist, and a first part and a second part, said first part being arranged horizontally movable with respect to said second part from a training position, in which said first part is in air pressure-tight engagement with said second part, into an access position, in which said first part and second part are spaced apart from each other to form an access opening, an access drive system generating a moving force acting on said first and second part and adapted to support transfer of said first and second part from said training position into said access position, and a locking device is provided, locking said first to said second part in said training position, said locking device being held in a locking position by one of a pressure and an electromagnetic force generated by said drive system, an exercise device arranged within said pressure chamber, said exercise device having a seat for taking off the weight of said person's legs, an actuation device having a pair of movable actuation surfaces where exercise work can be introduced from said person's legs into said exercise device, and a resistance means connected to said actuation surfaces and adapted to absorb said exercise work, wherein said actuation device and said seat are arranged to be movably adjustable relative to each other and to said opening.

* * * * *